US006260927B1

(12) United States Patent
Sajakorpi et al.

(10) Patent No.: US 6,260,927 B1
(45) Date of Patent: Jul. 17, 2001

(54) METHOD AND APPARATUS FOR MANUFACTURING OF A BRUSH RING

(75) Inventors: Kimmo Sajakorpi; Reijo Kuivikko, both of Tampere (FI)

(73) Assignee: Pesmel Oy, Kauhajoki (FI)

( * ) Notice: Subject to any disclaimer, the term of this patent is extended or adjusted under 35 U.S.C. 154(b) by 0 days.

(21) Appl. No.: 09/011,529

(22) PCT Filed: Oct. 9, 1997

(86) PCT No.: PCT/FI97/00615

§ 371 Date: May 6, 1998

§ 102(e) Date: May 6, 1998

(87) PCT Pub. No.: WO98/20773

PCT Pub. Date: May 22, 1998

(30) Foreign Application Priority Data

Nov. 11, 1996 (FI) ..... 964514
Nov. 11, 1996 (FI) ..... 964515

(51) Int. Cl.[7] ..... A46D 3/00
(52) U.S. Cl. ..... 300/21
(58) Field of Search ..... 300/21

(56) References Cited

U.S. PATENT DOCUMENTS 2,655,409 10/1953 Baldanza .
3,490,087 1/1970 Krier et al. .
4,998,316 3/1991 Maltarp ..... 15/181
5,588,172 12/1996 Biocca .

FOREIGN PATENT DOCUMENTS 39 14 745 A1 11/1989 (DE) .
87977 12/1992 (FI) .
963433 9/1996 (FI) .

*Primary Examiner*—Randall E. Chin
(74) *Attorney, Agent, or Firm*—Connolly Bove Lodge & Hutz, LLP

(57) ABSTRACT

The invention relates to a method for manufacturing of a brush ring, whereby the brush ring is intended to be used particularly with several corresponding brush rings as a brush, that rotates around a longitudinal axis, in a brushing machine. The brush ring consists of a brush part (1) and a ring shaped frame part (2), that connects the radially directed (r) brushes (1*a*) forming the brush part (1), which parts (1, 2) are formed as a uniform entirety preferably from plastic based material, and in which there has been arranged at least holding means (3) to prevent the brush ring from twisting, when the same has been assembled in place to the brush frame of the brushing machine. The brush ring is being manufactured from an essentially elongated brush preform (1'), in which the brushes (1*a*) are connected to each other by melting (1's), wherein on the melting (1's) existing at the top edge of the brush preform (1'), that moves along in an essentially upright position, plastic paste (2'), is being led, that is in an essentially solid state, to work the brush ring to its final shape by means of a press mold assembly (X) by forming the frame part (2) and preferably the holding means (3) from the said plastic paste (2'). The plastic paste (2') is being led bent in a ready finished shape, such as through a U-shaped extrusion groove (U) or correspondingly, on top of the melting edge (1's) of the brush preform (1'), that is as an advantageous embodiment being preheated in the same connection. The invention relates to an apparatus, also, that operates according to the method.

32 Claims, 5 Drawing Sheets

METHOD AND APPARATUS FOR MANUFACTURING OF A BRUSH RING

FIELD OF THE INVENTION

The invention relates to a method for manufacturing of a brush ring, whereby the brush ring is intended to be used particularly with several corresponding brush rings as a brush, that rotates around a longitudinal axis, in a brushing machine. The brush ring consists of a brush part and a ring shaped frame part. The frame part connects the radially directed bristles forming the brush part. The frame and the brush parts are formed as a single member uniformly from plastic based material. In the frame part there has been arranged at least holding means to prevent the brush ring from twisting, when the brush ring has been assembled in place to the brush frame of the brushing machine with the other brush rings placed one after another in the longitudinal direction. The brush ring is manufactured from an essentially elongated brush preform, in which the bristles are connected to each other by melting bristles together at one end to form a melted edge. On the melted edge existing on top of the brush preform, that moves along in an essentially upright position, plastic paste is fed in. The plastic paste is in an essentially solid state, to enable the brush ring to be worked to its final shape by means of a press mold assembly by forming the frame part and preferably the holding means from the plastic paste.

BACKGROUND OF THE INVENTION

The type of brush rings described above are used to form brushes in different kinds of sweeping trucks and brushing machines. The brush rings being used today usually comprise a ring shaped frame part. In other words, the frame part has been formed to a circumferential shape when viewed from the side. The ring shaped frame part is usually made of thin sheet iron, the thickness of which is, for example, about 1 mm. The bristles have been attached to this kind of frame part, for example, by means of a suitable solidifying attachment mass. This type of brush ring is usually planar.

This type of brush ring, that is partly made of metal, tends to break particularly because of cold, which causes stiffening of the brushes. On such an occasion, the frame sheet iron supporting the brush part of the brush ring opens in certain places, in which case bigger or smaller units of brush parts are released from the brush ring. In addition to the foregoing problem, it is practically impossible to re-use brush rings with metal frames and plastic brushes, because removing the frame sheet iron from the brushes is not economically justified in practice. That is why this type of brush ring is removed as a whole to the dumping area. That is naturally a significant waste problem. Furthermore, when the type of brush rings described above are being used, very strongly built supporting structures must be used, also, such as space rings made of metal, fastening rings etc., which is why a brush formed of this kind of brush rings becomes disproportionately expensive.

On the other hand from Finnish Patent No. 87977, a brush element is previously known, that is entirely made of plastic based material. When applying the method according to the afore-mentioned patent, plastic paste existing essentially in a solid shape is fed onto the melted edge existing at the top edge of the brush preform, that moves along in an essentially upright position, to work the brush ring to its final shape by means of a press mold assembly by forming the frame part and preferably the holding means from the plastic paste. However, arrangements explained in Finnish Patent No. 87977 in particular for feeding the plastic paste on top of the melted edge of the brush preform are insufficient when being carried out in practice. This leads to the plastic paste becoming unevenly distributed on the brush preform. This leads furthermore to the result that, when pressing the brush preform to bring out a final brush ring, the final brush ring is not adequately as homogeneous. This results in many significant disadvantages in practice, when the brush ring is being used in a brushing machine, wherein, for example, vibration is caused due to unbalance. Furthermore, due to the above-noted extra wearing of the brushing machine, discomfort in the use of the machine is caused as well. Furthermore, the brush elements being manufactured by the method described in the patent above are planar. Thus, due to wearing of the brushes, the brushing of the brush formed of the brush rings becomes discontinuous in the longitudinal direction of the brush, particularly in the jointing points of the brush rings. Therefore, the brush is not able to fulfill, to a satisfactory extent, conventional demands that are requested in certain purposes, because material to be brushed may go through the brush without touching the bristles, in which case the brush must be dismantled and the brush rings replaced.

SUMMARY OF THE INVENTION

It is the aim of the method for manufacturing of a brush ring according to the present invention to achieve a decisive improvement in the problems presented above and, thus, to essentially raise the level of knowledge in the field. To achieve this aim the method according to the present invention is primarily characterized in that the plastic paste is fed out formed into a ready finished shape, such as through a U-shaped extrusion groove or the like, onto the brush preform, preferably on top of a melted edge of the brush preform, that is being simultaneously preheated.

Among the most important advantages of the method are simplicity and reliability. Thanks to the invention, it is possible to produce brush rings, the manufacturing costs of which are significantly more profitable and that are more homogeneous than present brush rings. In particular the forming of the plastic paste into a desired shape in advance improves significantly homogeneity of the brush rings, because the plastic paste forming the frame part is prevented from being unevenly distributed. Thanks to the invention, the brush rings manufactured by this method are both very user-friendly and durable, particularly due to their homogeneity. When exploiting advantageously preheating of the brush preform, the method according to the invention furthermore assures that the contact between the solid melting paste connecting the brush preform and brush ring to each other is achieved reliably and effectively when the plastic paste is extruded on the brush preform. The preheating described above also causes roughness of the melted edge of the brush preform to be balanced by influence of heating, which furthermore enables a contact as even as possible between the melted edge and the plastic paste.

Advantageous embodiments of the method according to the invention are described below.

The invention relates to an apparatus functioning according to the principle of the method as well, that is being described in a greater detail below.

The most important advantages of the apparatus according to the invention include simplicity and reliability of its construction and use. By very simple arrangements, for example, when advantageously preheating the brush preform during extrusion, it is possible to achieve a uniform and continuous contact between the melted edge of the brush preform and the plastic paste to be extruded on it. The brush rings manufactured by the apparatus are particularly homogeneous, due to the extrusion groove existing in the extrusion device belonging to the apparatus. The shape of the groove corresponds to the shape of the brush preform and places the plastic paste in a ready formed shape on the brush preform, thereby preventing it from being unevenly distributed. The brush rings manufactured by the apparatus according to the invention hold together particularly well due to contact between the plastic paste forming the frame part and the brush preform forming the brush part being sufficiently efficient due to preheating. Accordingly, the brush rings manufactured by the apparatus, in addition to being homogeneous are also durable due to a strong structure. It is advantageous to use the apparatus according to the invention particularly in connection with a brush ring, in which the touching point of the outer radial edge of the brush part of the brush ring has an effect within the whole width of the brush ring, to achieve an essentially unbroken brush touch in the longitudinal direction of the brushing machine to the object being brushed continuously regardless of the length of the bristles, when the brush rings forming the brush keep rotating around the longitudinal axis. The brushing result of this type of zig-zag brush ring remains optimal with a respect to brushing effect despite wearing of the bristles significantly longer than with currently utilized planar brush rings. That means, in principle, until the bristles wear out.

Advantageous embodiments of the apparatus according to the invention are described below.

BRIEF DESCRIPTION OF THE DRAWINGS

In the following description, the invention is illustrated in greater detail with reference to the appended drawings, in which.

DETAILED DESCRIPTION OF THE INVENTION

The invention relates to a method for manufacturing of a brush ring. The brush ring is intended to be used particularly with several corresponding brush rings as a brush, that rotates in a direction w around a longitudinal axis s, in a brushing machine. The brush ring consists of a brush part 1 and a ring shaped frame part 2, that connects the bristles 1 a radially directed in a direction r and forming the brush part 1. Parts 1, 2 are formed, preferably, as a single member uniformly from plastic based material. In the frame part 2 there has been arranged at least holding means 3 to prevent the brush ring from twisting, when the parts have been assembled in place to the brush frame of the brushing machine.

Figure 4A:
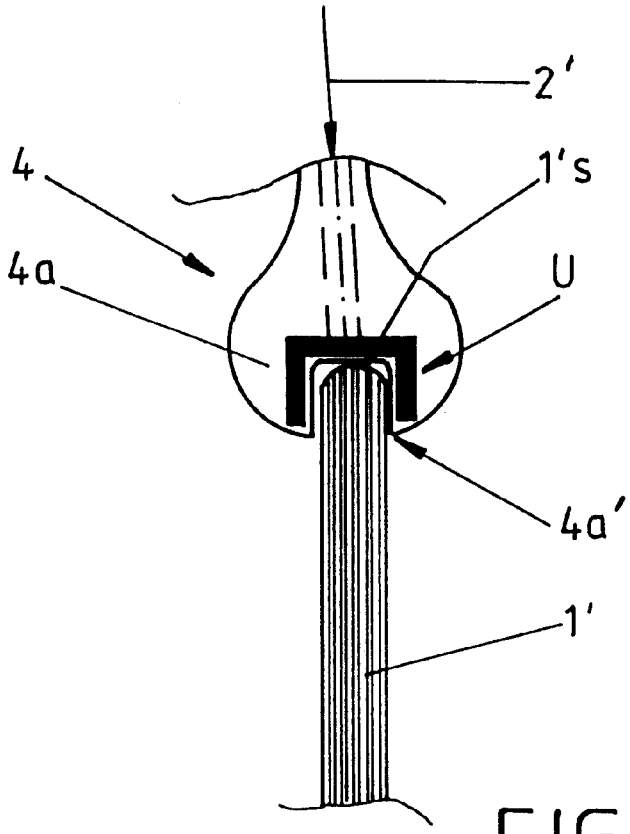
FIGS. 4*a* and 4*b* show, respectively, a front view and a side view of an extrusion frame of an apparatus applying the method according to the invention.
Figure 4B:
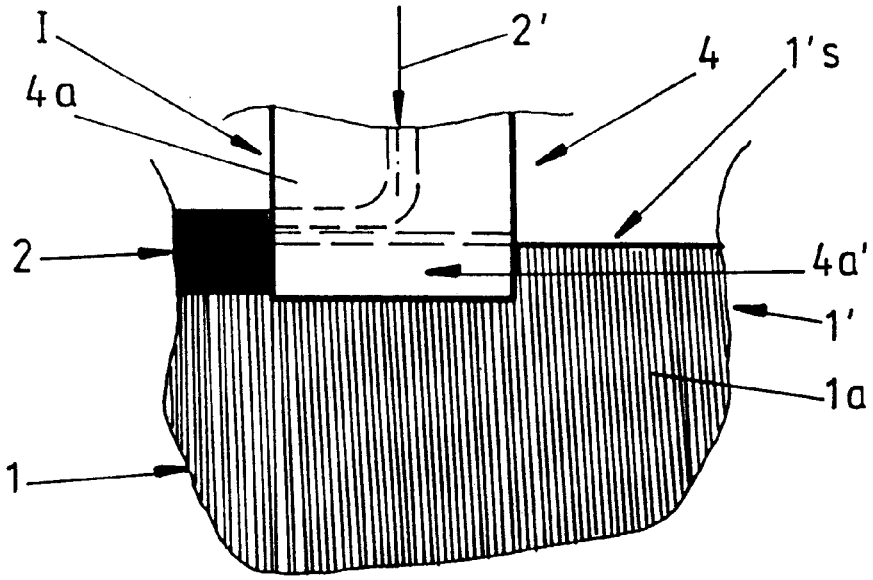

As shown in FIGS. 4*a* and 4*b*, the brush ring is manufactured from an essentially elongated brush preform 1'. The bristles 1*a* are connected to each other by melting together ends of the bristles 1*a* to form a melted edge 1's. Upon the melted edge 1's existing on top of the brush preform 1', which moves along in an essentially upright position, plastic paste 2' in an essentially solid state is advanced. The brush ring is worked to its final shape by means of a press mold assembly X by forming the frame part 2 and preferably the holding means 3 from the plastic paste 2'. The plastic paste 2' is advanced formed into a ready finished shape, such as through a U-shaped extrusion groove U or the like, on top of the melted edge 1's of the brush preform 1'. The brush preform 1' is advantageously preheated.

As a particularly advantageous embodiment, the extrusion device 4 that feeds solid plastic paste 2', such as an extruder or the like, comprises a heated and an essentially elongated extrusion frame 4*a*. Inside of frame 4*a* the brush preform 1' is advanced through a passage duct 4*a*' existing therewith, particularly for preheating of the melted edge 1's of the brush preform 1' before extruding the plastic paste 2' on it.

The principle described above may be observed particularly from FIGS. 4*a* and 4*b*, which show an extrusion frame of an extrusion device applying the method according to the invention as a front view and a side view. Furthermore in the advantageous brush rings shown in FIGS. 2 and 3*a*, principles of the applicants previous Finnish patent application FI 963433, "Harjakiekko" have been adapted.

Figure 2:
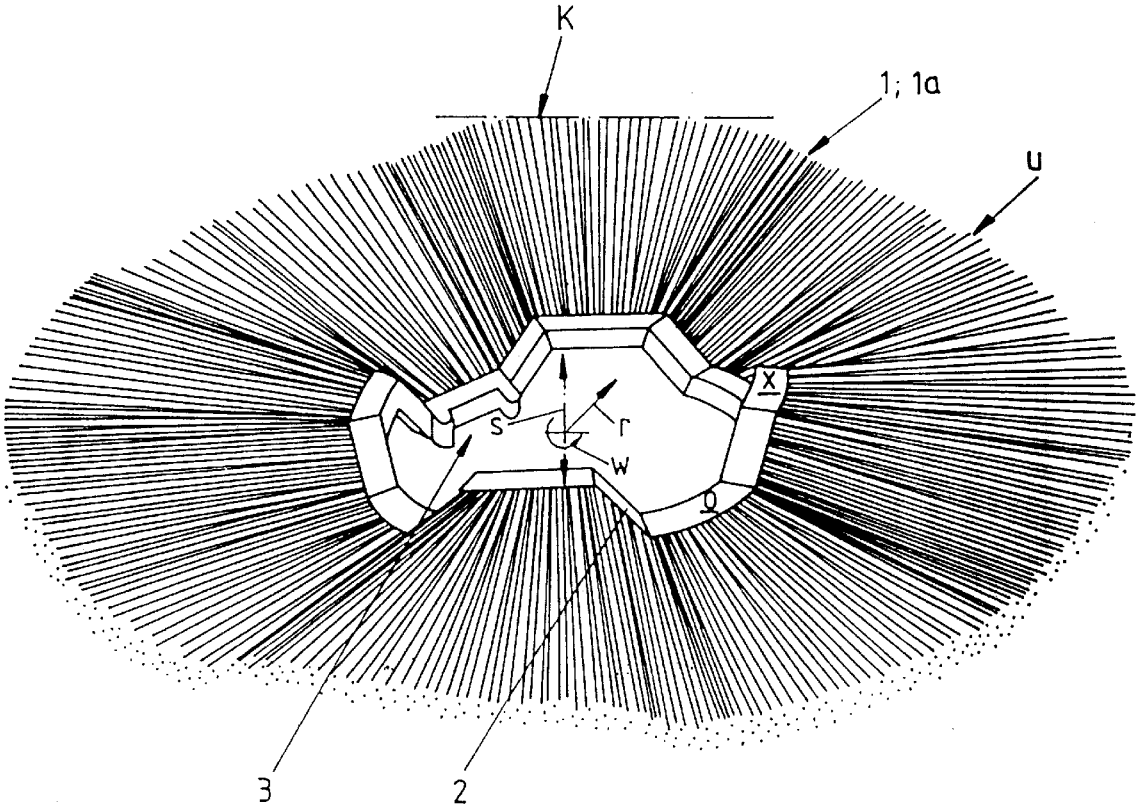
FIG. 2 shows a perspective view of an advantageous brush ring according to the present invention.

As shown in FIG. 2, the frame part 2 of the brush ring has an essentially constant cross section. The frame part 2 undulates in a wave-type form having at least a lower level o and an upper level x. The upper level x is displaced from the lower level o in a direction s. A three-dimensional press mold assembly X, shown in FIGS. 5*a* and 5*b*, may be used to form the frame part 2 into the described shape. The press mold assembly X has press molds X1. In an advantageous embodiment, surfaces of the press molds X1 that come into contact with the frame part 1 and brush part 2 during formation of the brush ring have four projections for forming portions of the ring on the x level, to one side si of the lower level o, as shown in FIG. 3*b*.

Figure 1A:
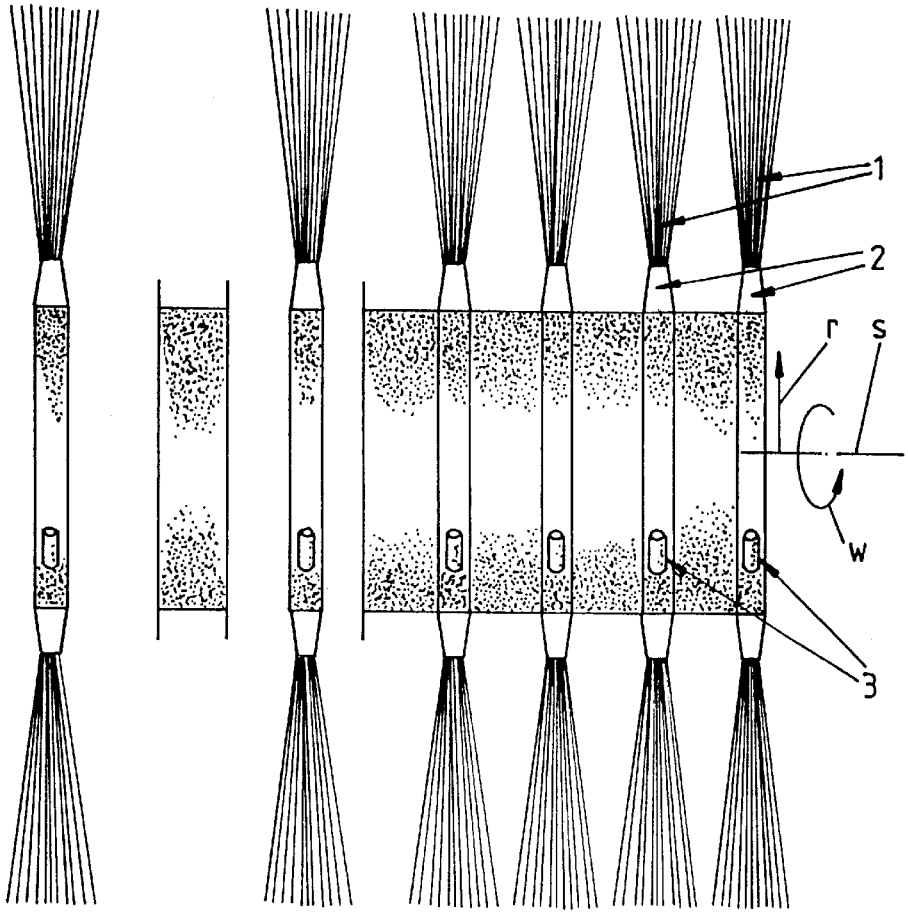
FIGS. 1*a* and 1*b* show sectional side views of a brush formed of conventional brush rings as after brief use (a) and after heavy use (b)
Figure 1B:
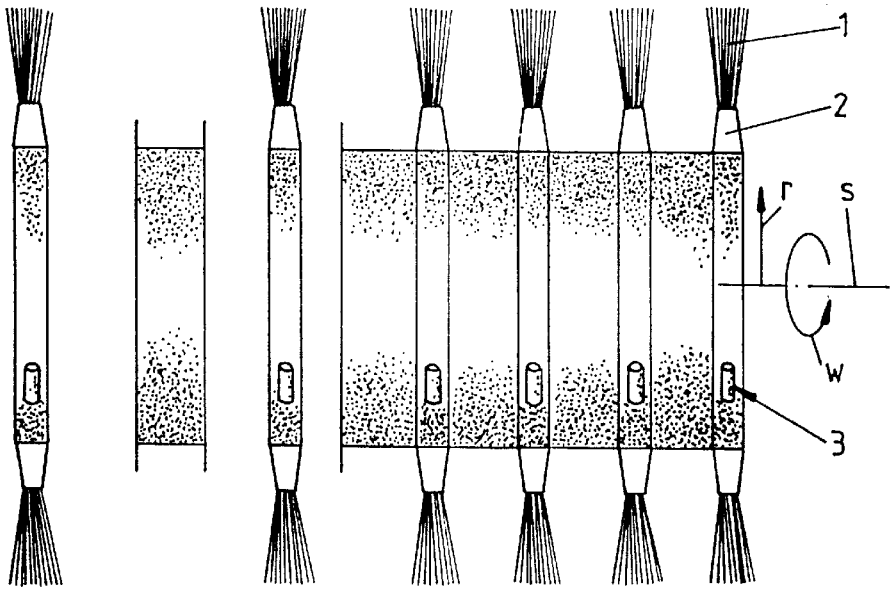

When comparing a known brush, as shown in FIGS. 1*a* and 1*b*, and its function with a brush formed of brush rings according to the invention and its function, it may be observed that the brush ring according to the invention may be used in principle as long as an adequate brushing effect may still be obtained with the bristles. When coupling known brush rings, space collars are always needed in principle between the brush rings placed one after another. This points out furthermore unsatisfactory functioning of known planar brush rings in the respect that, due to wearing of the bristles, with reference particularly to FIG. 1*b*, the brushing surface presented by the outer radial edge of the brush very quickly becomes discontinuous. For example, the brush shown in FIG. 1*b* would not be useable any more for most usual purposes. Similarly, the brush shown in FIG. 1*a* would already be nearly unsatisfactory for certain especially demanding purposes.

Furthermore as an advantageous embodiment of the method, the entire brush ring, including the bristles 1*a* forming the brush part 1 and the plastic paste 2' forming the frame part, may be manufactured from recyclable and preferably essentially the same manufacturing material, such as polypropylene.

Furthermore as an advantageous embodiment, the width of the plastic paste 2' extrusion is adjusted to correspond essentially to the width of the brush preform 1' of each brush ring to be manufactured by using extrusion frames 4*a* having, for example, interchangeable extrusion grooves U and/or passage ducts 4*a'* with different dimensions.

The apparatus for manufacturing the type of brush rings described above comprises, thus, at least an extrusion frame 4*a* to feed plastic paste 2', formed into a ready finished shape, such as through a U-shaped extrusion groove U or the like, on the brush preform 1', that is preferably preheated. After extrusion, the brush ring may be worked to its final shape between the press mold assembly X to form both the frame part 2 and advantageously the holding means 3 as well from the plastic paste 2'.

As an advantageous embodiment the extrusion device 4 feeding solid plastic paste 2' comprises a heated and particularly with reference to FIG. 4*b*, an essentially elongated extrusion frame 4*a*, to guide the brush preform 1' inside the same through a passage duct 4*a'*, particularly for preheating the melted edge 1's of the brush preform 1' before extruding the plastic paste 2' on it. As an advantageous embodiment, the extrusion groove U and/or the passage duct 4*a'* of the extrusion device 4 are connected removably to the extrusion frame 4*a*, to adjust, for example, the width of the extrusion and/or of the passage duct to correspond essentially to the width of the brush preform 1' of each brush ring to be manufactured. Furthermore, with reference particularly to FIG. 4*a*, the extrusion frame 4*a* has a passage duct 4*a'* at its bottom, the width of which corresponds essentially to the width of the brush preform 1', when viewed in a cross section as shown in FIG. 4*a*. Furthermore, with reference to FIG. 4*b*, at the extrusion end I of the extrusion frame 4*a*, the extrusion groove U existing therein surrounds the passage duct 4*a'*.

Furthermore, as an advantageous embodiment, the brush ring has been worked to its final shape by means of the press mold assembly X, whereby the holding means 3 are formed simultaneously, when the frame part 2 is being pressed to the press mold assembly X, by means of a counterpart surface arrangement 6 existing in the press mold assembly X, whereby the holding means 3 are formed by means of material spreading from the frame part 2 thereto during pressing. The counterpart surface arrangement 6 is a unit, that is connected removably to the press mold assembly X, particularly for preparing brush rings with differing holding means 3 by replacing only the counterpart surface arrangement 6 and otherwise using one and the same press mold assembly X.

Furthermore as an advantageous embodiment of the invention, the counterpart surface arrangement is intended particularly for manufacturing of a brush ring that comprises an essentially circumferential frame part 2, when viewed from the side, in which case the holding means 3 comprises at least one shoulder arrangement 3*a* existing therewith and, whereby the brush part 1 and the frame part 2 are entirely made of recyclable and preferably essentially of the same manufacturing material, such as polypropylene. With reference to the embodiments shown particularly in FIGS. 3*a*, 5*a* and 5*b*, the counterpart surface arrangement 6 has been attached removably, preferably, to the lower press mold X1 of the press mold assembly X, preferably by means of a quick locking principle, such as by means of a form locking joint, screw joint 5 and/or the like.

Figure 3A:
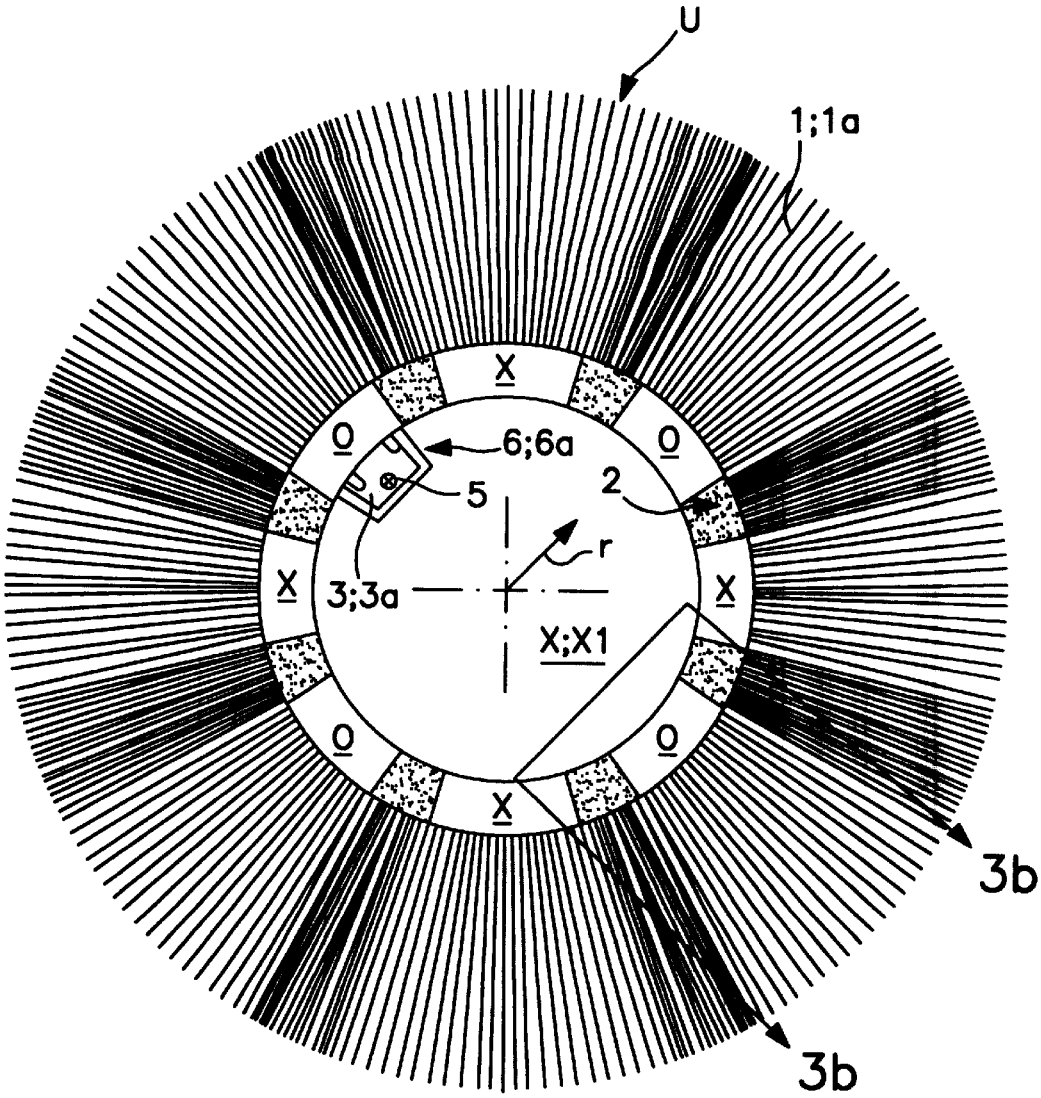
FIG. 3*a* shows a front view of manufacturing of the brush ring shown in FIG. 2.
Figure 3B:
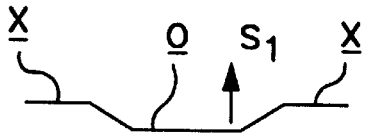
FIG. 3*b* shows a cross-sectional view of a portion of the brush ring, as seen along lines 3*b*—3*b* of FIG. 3*a;*
Figure 5A:
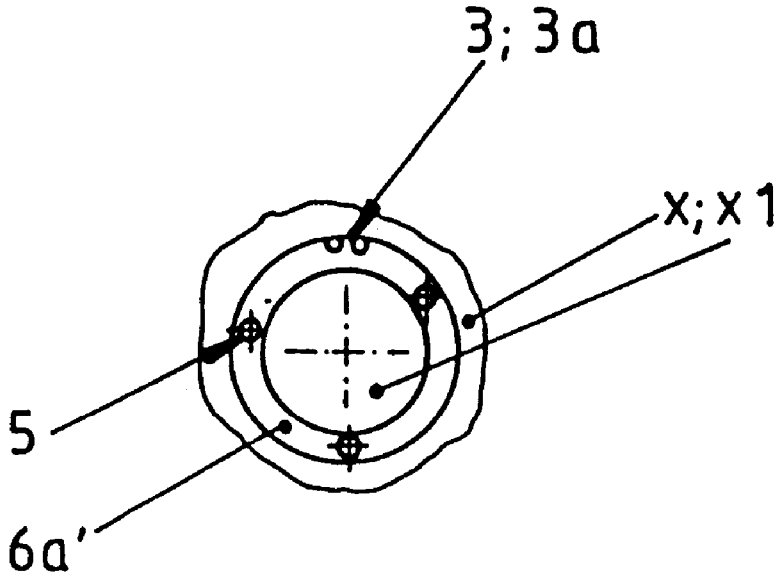
FIGS. 5*a* and 5*b* show advantageous counterpart surface arrangements of an apparatus applying the method according to the invention.
Figure 5B:
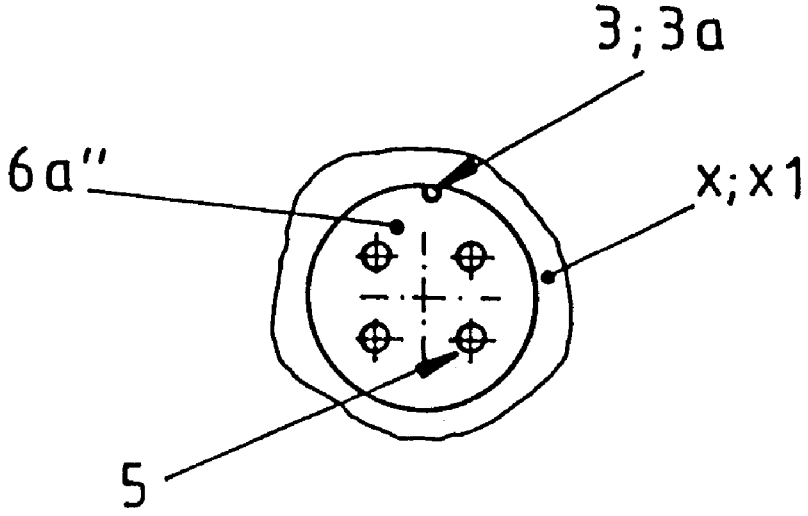

With reference particularly to the advantageous embodiment shown in FIG. 3*a*, the counterpart surface arrangement 6 is carried out by an interchangeable counterpart piece 6*a*, that is placed essentially at the point of the holding means 3 in the press mold X1. Furthermore as an advantageous embodiment, the counterpart surface arrangement 6 may be arranged, i.e., implemented, by one uniform interchangeable counterpart surface existing in the press mold X1, that is, for example, continuously pressed against the frame part 2 in the radial direction. Such a uniform interchangeable counterpart surface may be formed, as shown in FIG. 5*a*, of a uniform circular ring 6*a'*, and as shown in FIG. 5*b* of, for example, an essentially uniform planar interchangeable counterpart plate 6*a"*. The essentially uniform planar interchangeable counterpart plate 6*a"* may be attached to a surface of the press mold. The surface of the press mold may be essentially planar.

It is obvious, that the invention is not limited to the embodiments presented or described above, but it can be modified within the basic idea even to a great extent. In this case, it is first of all possible to form the type of brush rings described above of a frame part, that is, for example, wider than described above and into which there has been attached, for example, one single spiral-shaped brush part that has been implemented by means of a two or multiple ended threading. It is also possible to exploit the principle described above on the other hand by using a solution like the one shown in FIG. 2, in which the frame part comprises a structure, that has, for example, knees extending sidewards instead of a structure having a constant cross section. It is also possible to equip the brush rings according to the invention with auxiliary holding arrangements, functioning, for example, on the male-female-principle and that are placed at the axially directed side surfaces of the frame parts in the brush ring, in which case auxiliary counterpart surface arrangements for the above are naturally needed. It is naturally possible to produce a brush ring according to the invention from most heterogeneous materials, by exploiting most heterogeneous manufacturing methods. In the foregoing description, use of polypropylene as the manufacturing material of the brush rings has been represented as only one example, that is, however, a very suitable alternative in this context.

What is claimed is:

1. A method for manufacturing a brush ring that is to be used with a plurality of similar brush rings as a brush that rotates around a longitudinal axis in a brushing machine, the brush ring comprising a brush part formed of radially directed bristles and a ring shaped frame part that connects the bristles, the brush part and the frame part being formed as a single member and including holding means for preventing the brush ring from twisting when the plurality of brush rings have been assembled one after another in a longitudinal direction on a brush frame of a brushing machine, the method comprising:

providing an essentially elongated brush preform in which the bristles are connected to each other at one end;

feeding plastic paste in an essentially solid state onto said one end of the bristles at a top edge of the preform, the plastic paste being fed in a finished shape; and working the brush ring to a final shape utilizing a press mold assembly to form at least the frame part from the plastic paste.

2. The method according to claim 1, wherein the plastic paste is fed on the preform as the preform moves along in an essentially upright position.

3. The method according to claim 1, wherein the bristles are connected to each other by melting.

4. The method according to claim 3, wherein the plastic paste is fed on top of the melted bristles.

5. The method according to claim 4, further comprising:

preheating the preform prior to feeding the plastic paste.

6. The method according to claim 1, wherein the plastic paste is applied with an extrusion device that feeds the plastic paste bent in a finished shape.

7. The method according to claim 6, wherein the plastic paste is fed through a U-shaped extrusion groove.

8. The method according to claim 6, wherein the extrusion device is an extruder.

9. The method according to claim 6, wherein the extrusion device comprises a heated and essentially elongated extrusion frame including a passage duct through which the brush preform is fed for preheating the melted bristles before extruding the plastic paste on the preheated melted bristles.

10. The method according to claim 9, wherein the extrusion frame is removably connected to the extrusion device and comprises a variable size passage duct having a shape adjustable to correspond to a width of the brush preform.

11. The method according to claim 1, further comprising:

preheating the preform prior to feeding the plastic paste.

12. The method according to claim 1, wherein working the brush ring also formed the holding means from the plastic paste.

13. An apparatus for manufacturing a brush ring that is to be used with a plurality of similar brush rings as a brush that rotates around a longitudinal axis in a brushing machine, the brush ring comprising a brush part formed of radially directed bristles and a ring shaped frame part that connects the bristles, the brush part and the frame part being formed as a single member and including holding means for preventing the brush ring from twisting when the plurality of brush rings have been assembled one after another in a longitudinal direction on a brush frame of a brushing machine, wherein the brush ring is manufactured from an essentially elongated brush preform in which the brushes are connected to each other at one end, the apparatus comprising:

an extrusion device including an extrusion frame for feeding plastic paste in an essentially solid state on the joined together end of the bristles, wherein the plastic paste is arranged to be led bent in a ready finished shape; and a press mold assembly for working the brush ring to a final shape by forming at least the frame part from the plastic paste.

14. The apparatus according to claim 13, wherein the extrusion frame comprises a U-shaped extrusion groove through which the brush preform is fed.

15. The apparatus according to claim 13, wherein the extrusion device preheats the melted end of the bristles prior to feeding the plastic paste on the melted end of the bristles.

16. The apparatus according to claim 13, wherein the brush preform travels in an essentially upright position through the extrusion device, the extrusion is arranged on top of the melted end of the bristles to feed the plastic paste on the top of the melted end of the bristles.

17. The apparatus according to claim 13, wherein the press mold also forms the holding means from the plastic paste.

18. The apparatus according to claim 13, wherein the extrusion device is an extruder.

19. The apparatus according to claim 13, wherein the extrusion frame is heated and essentially elongated and comprises a passage duct that the brush preform is fed through, the melted end of the bristles being preheated by passing through the heated extrusion frame before extruding the plastic paste.

20. The apparatus according to claim 19, wherein the apparatus comprises extrusion frames that are removably connected to the extrusion device and that have mutually differing extrusion grooves and/or passage ducts for adjusting a shape of the extrusion grooves and/or the passage ducts to correspond to a width of the brush preform.

21. The apparatus according to claim 13, wherein the apparatus comprises extrusion frames that are removably connected to the extrusion device and that have mutually differing extrusion grooves and/or passage ducts for adjusting a shape of the extrusion grooves and/or the passage ducts to correspond to a width of the brush preform.

22. The apparatus according to claim 21, wherein the extrusion frame comprises an extrusion groove arranged at an extrusion end of the extrusion frame, wherein the extrusion groove surrounds the passage duct.

23. The apparatus according to claim 13, wherein the extrusion frame comprises a passage duct at a bottom of the extrusion frame, a breadth of the passage duct corresponding essentially to a cross-sectional breadth of the brush preform.

24. The apparatus according to claim 13, further comprising:

a counterpart surface removably connected to the press mold assembly for manufacturing brush rings with different holding means by rearranging the counterpart surface.

25. The apparatus according to claim 24, wherein the counterpart surface is removably attached to a lower press mold of the press mold assembly.

26. The apparatus according to claim 24, wherein the counterpart surface is removably attached to the press mold assembly with a quick locking principle.

27. The apparatus according to claim 26, wherein the quick locking principle comprises a form locking joint and/or a screw joint.

28. The apparatus according to claim 24, wherein the counterpart surface is attached to the press mold assembly with an interchangeable counterpart piece that is placed essentially at the holding means.

29. The apparatus according to claim 24, wherein the counterpart surface is arranged by a uniform interchangeable counterpart surface in the press mold that is continuously against the frame part in a radial direction.

30. The apparatus according to claim 29, wherein the interchangeable counterpart surface is arranged by a uniform circular ring in a longitudinal direction.

31. The apparatus according to claim 29, wherein the interchangeable counterpart surface is arranged by a uniform planar structure to be attached against an essentially planar press mold surface.

32. The apparatus according to claim 31, wherein the uniform planar structure comprises a plate or sheet.

* * * * *

UNITED STATES PATENT AND TRADEMARK OFFICE

CERTIFICATE OF CORRECTION

PATENT NO. : 6,260,927 B1
DATED : July 17, 2001
INVENTOR(S) : Sajakorpi et al.

It is certified that error appears in the above-identified patent and that said Letters Patent is hereby corrected as shown below:

Title page,
Item [73] Assignee should read --- Sajakorpi Oy, Tampere [FI] ---.

Signed and Sealed this

Ninth Day of October, 2001

*Attest:*

Nicholas P. Godici

*Attesting Officer*

NICHOLAS P. GODICI
*Acting Director of the United States Patent and Trademark Office*